United States Patent [19]

Bianchetta et al.

[11] Patent Number: 4,487,255

[45] Date of Patent: Dec. 11, 1984

[54] CONTROL FOR A FLUID-DRIVEN FAN

[75] Inventors: Donald L. Bianchetta, Coal City; Robert W. White, Joliet, both of Ill.

[73] Assignee: Caterpillar Tractor Co., Peoria, Ill.

[21] Appl. No.: 527,779

[22] PCT Filed: Dec. 17, 1981

[86] PCT No.: PCT/US81/01691

§ 371 Date: Dec. 17, 1981

§ 102(e) Date: Dec. 17, 1981

[87] PCT Pub. No.: WO83/02132

PCT Pub. Date: Jun. 23, 1983

[51] Int. Cl.[3] ..... F01P 7/02

[52] U.S. Cl. ..... 165/39; 236/35; 123/41.12; 417/213; 60/445

[58] Field of Search ..... 165/32, 39, 51; 236/35; 123/41.11, 41.12; 60/325, 445, 452, DIG. 5; 417/212, 213

[56] References Cited

U.S. PATENT DOCUMENTS

| | | | |
|---|---|---|---|
| 3,664,129 | 5/1972 | Schwab | 60/53 R |
| 3,797,245 | 3/1974 | Hein | 60/452 |
| 3,942,486 | 3/1976 | Kirchner | 123/41.12 |
| 3,995,425 | 12/1976 | Wittren | 60/445 |
| 4,036,432 | 7/1977 | George | 236/35 |
| 4,062,329 | 12/1977 | Rio | 123/41.12 |
| 4,066,047 | 1/1978 | Vidakovic et al. | 123/41.12 |
| 4,200,146 | 4/1980 | Olson | 165/39 |
| 4,223,646 | 9/1980 | Kinder | 123/41.11 |
| 4,373,869 | 2/1983 | Martin et al. | 417/213 |

*Primary Examiner*—Margaret A. Focarino
*Attorney, Agent, or Firm*—J. W. Burrows

[57] ABSTRACT

A fan drive system (10) controls the start-up of a fluid driven fan motor (16) in response to an engine being started. Since the fan motor (16) is many times located remote from the engine, it is important to start the fan motor (16) turning simultaneously when the engine is started. A control mechanism (32) changes the displacement of a pump (12) to operate at an operative position for a predetermined time period from initial start-up to ensure that the motor (16) starts to turn the fan (22). The control mechanism (32) automatically reduces the pump displacement to a standby position at the expiration of the predetermined time period to conserve energy.

8 Claims, 1 Drawing Figure

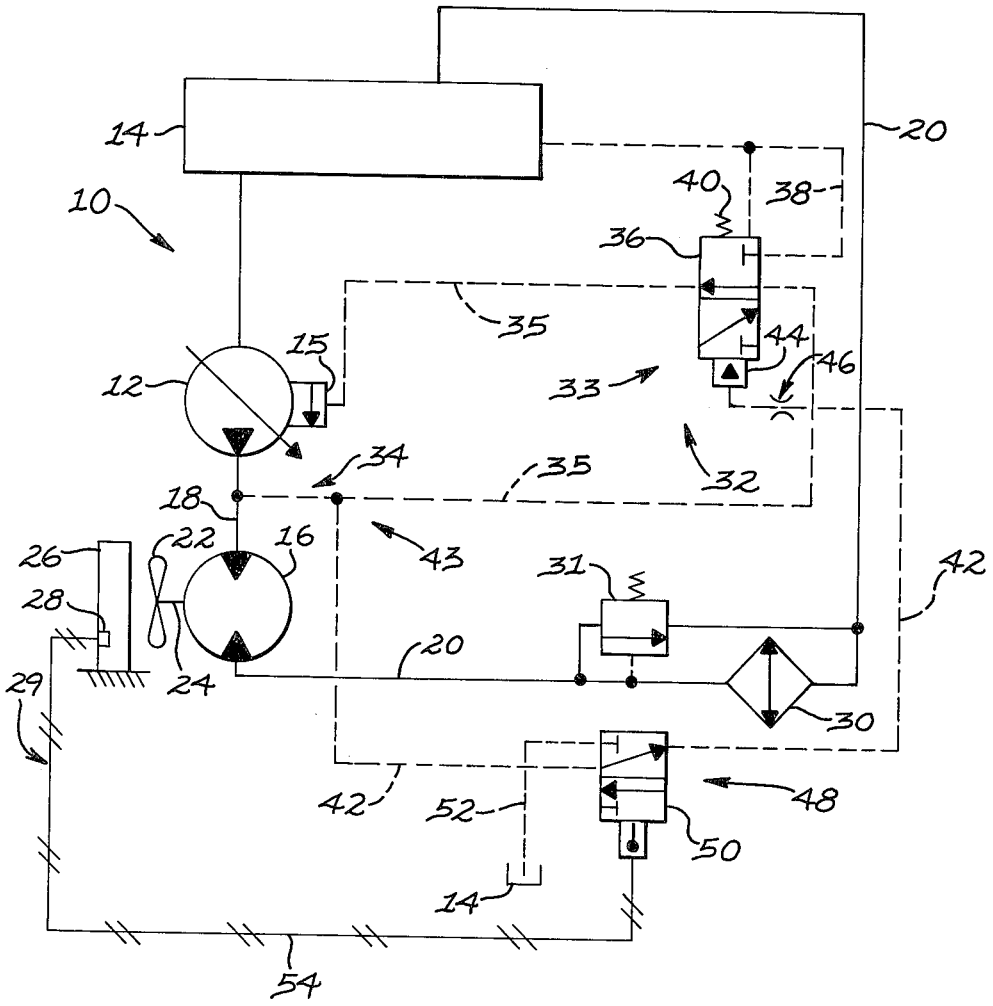
14
20
10
40
38
36
35
15
44
46
12
33
34
35
32
18
22
16
43
26
31
42
28
20
24
29
30
42
52
48
50
14
54

CONTROL FOR A FLUID-DRIVEN FAN

DESCRIPTION

Technical Field

This invention relates generally to a control for a fluid-driven fan and more particularly to a control arrangement for controlling the displacement of a variable displacement pump for controlling the speed of the fluid-driven fan in a vehicle.

Background Art

Fluid-driven fan systems make it possible to cool a heat exchanger on a vehicle remote from the engine. Most normally include a fan connected to a fluid motor with the fluid motor being driven by fluid from a variable displacement pump. Many of the systems use a signal representative of the temperature in the heat exchanger for changing the rate of flow to the motor. It is desirable to run the fan at a low speed when the temperature in the heat exchanger is below a predetermined level. The reduction of the flow from the pump when not needed reduces the horsepower consumed by the vehicle. For the protection of the operator and/or maintenance personnel, the fan should be turning when the engine is running. It would also be advantageous to reduce the pressure of the fluid from the pump during the low speed condition to further reduce horsepower consumption. The problem encountered, especially with larger motors, is the inability to start the motor turning when the engine is started with the pump at reduced flow and pressure.

The present invention is directed to overcoming one or more of the problems as set forth above.

Disclosure of the Invention

In one aspect of the present invention, a fan drive system has a fluid motor connected to a cooling fan with a variable displacement pump supplying fluid from a tank to drive the fluid motor. The variable displacement pump has a fluid control actuator to vary the pump's displacement. The cooling fan delivers air to a heat exchanger for cooling the heat exchanger. A means 32 is provided for changing the displacement of the pump 12 to operate at a first operative displacement position for a predetermined time period from initial start-up and automatically reducing the displacement of the pump to a second, standby displacement position at the expiration of the predetermined time period.

This invention solves the problem of the fan motor not starting when the engine is started in a system having a variable displacement pump which has low flow and pressure when the temperature of the heat exchanger is below the predetermined level. The control mechanism of this invention delivers a control signal to the control actuator of the variable displacement pump for initially adjusting the pump to deliver fluid to the motor at a pressure and flow sufficient for turning the motor and subsequently interrupting the control signal to reduce the pressure and flow of the pump. This results in a more energy efficient fan drive system while ensuring fan rotation at all times during engine operation.

Brief Description of the Drawings

The drawing is a schematic representation of an embodiment of the present invention.

Best Mode for Carrying Out the Invention

Referring now to the drawing, a fluid-driven fan drive system is generally indicated by reference numeral 10 and includes a variable displacement pump 12 connected to a tank or reservoir 14. A fluid control actuator 15 controls the flow and pressure of the pump 12. A fluid driven motor 16 is connected to the pump 12 by a conduit 18 and to the tank 14 by a conduit 20.

An output shaft 24 connects a cooling fan 22 to the motor 16 in a conventional manner. A heat exchanger 26 is mounted adjacent the cooling fan 22. A temperature sensor means 28 is located in the heat exchanger 26 for sensing the temperature in the heat exchanger and generating a signal 29 in response to the temperature exceeding a predetermined level. An oil cooler 30 and a by-pass relief valve 31 are connected to the conduit 20 in a conventional manner and located on a vehicle (not shown) adjacent the heat exchanger 26.

A means 32 is provided for changing the displacement of the pump 12 to operate at a first operative displacement position for a predetermined time period from initial start-up and automatically reducing the displacement to a second, standby position at the expiration of the predetermined time period.

The changing means 32 includes a first valve means 33 for selectively directing a control signal 34 from the pump 12 to the control actuator 15 of the pump 12 through a conduit 35. The valve means 33 includes a two position valve 36 located in the conduit 35 and connected to the tank 14 by a conduit 38. A spring 40 biases the two position valve 36 to a first position. The valve means 33 also includes a means 46, such as an orifice 46, for delaying the movement of the two position valve 36 for a predetermined time period.

A second valve means 48 is provided for selectively directing fluid from the pilot source 43 to move the first two position valve 36 to the second position. The second valve means 48 includes a conduit 42 connected at one end to a source 43 of pressurized pilot fluid, such as pump 12, by the conduits 35,18 and at the other end to a pilot chamber 44 of the two position valve 36. The second valve means 48 also includes a temperature responsive valve 50 located in the conduit 42 and connected to the tank 14 by a conduit 52. A signal line 54 connects the temperature responsive valve 50 to the temperature sensor means 28.

Industrial Applicability

The present invention has particular utility in fluid-driven fan drive systems having a variable displacement pump with displacement controls to ensure that the motor initially starts to turn in response to engine start up and the pump immediately returns to low stand-by flow and pressure while the motor continues to turn but at a low speed.

The pump 12 delivers fluid to the motor 16 at the time the engine of the vehicle is started. The fluid control actuator 15 controls the flow and pressure of the pump 12 as is more fully described in U.S. Pat. No. 3,797,245 dated Mar. 19, 1974 by Allyn J. Hein.

The control signal 34 from the pump 12 communicates with the fluid control actuator 15 through the conduit 35 and the first position of the valve 36 to maintain the pump 12 at a pressure level to start the motor turning, for example 9100 kPa (approximately 1325 psi). The source 43 of pressurized pilot fluid is simultaneously directed to the pilot chamber 44 of the valve 36 through the conduit 42, the first position of the temperature responsive valve 50 and the orifice 46 for moving the valve 36 to the second position. The orifice 46 delays the movement of the valve 36 from the first position to the second position since the rate of flow into pilot chamber 44 is reduced. At the second position of the valve 36, the control signal 34 is blocked and the control actuator 15 is connected to the tank 14 by the conduits 35,38.

The fluid control actuator 15 decreases the displacement of the pump 12 to a low standby pressure, for example 1380 kPa (approximately 200 psi), at the second position of the valve 36. The low flow at standby pressure continues the fan 22 turning at a low speed to conserve engine horsepower when the temperature level in the heat exchanger is below the predetermined level.

The temperature responsive valve 50 moves to the second position in response to the temperature level in the heat exchanger 26 exceeding the predetermined level. At the second position, the source of pressurized pilot fluid is blocked and the pilot chamber 44 of the valve 36 is connected to the tank 14 by the conduits 42 and 52.

The spring 40 biases the valve 36 to the first position communicating the control signal 34 to the fluid control actuator 15 to increase the displacement of the pump 12 to operate at the higher pressure level of 9100 kPa thus driving the fan at the desired high speed to cool the heat exchanger 26. The pump 12 continues to operate at the higher pressure level until the temperature in the heat exchanger 26 is below the predetermined level.

Fluid exhausted from the motor 16 is passed to the tank 14 through conduit 20 and the oil cooler 30. Should the volume of oil from the motor 16 exceed the capacity of the oil cooler 30, the excess oil is by-passed around the oil cooler to tank 14 by the relief valve 31.

The controls for this system provide a fan drive that immediately starts fan rotation in response to starting of the engine and then automatically provides a slow speed fan drive in response to the temperature in the heat exchanger being below a predetermined level to conserve energy by reducing wasted horsepower.

Other aspects, objects and advantages of this invention can be obtained from a study of the drawing, disclosure and appended claims.

We claim:

1. In a fan drive system (10) having a fluid motor (16) connected to a cooling fan (22), a tank (14), a variable displacement pump (12) having a fluid control actuator (15), the pump (12) being connected to the fluid motor (16) for driving the fan (22), a source (43) of pressurized pilot fluid, and a heat exchanger (26) adapted to receive air from the cooling fan (22), the improvement comprising:

means (32) for changing the displacement of the pump (12) to operate at a first operative displacement position for a predetermined time period from initial start-up and automatically reducing the displacement of the pump (12) to a second, standby displacement position at the expiration of said predetermined time period, said pump being changed to the first operative position in response to a control signal directed to the control actuator (15) and to the standby position in the absence of said control signal;

said displacement changing means (32) including first valve means (33) movable to a first position to direct the control signal (34) to the control actuator (15) and to a second position to block the control signal (34) to the control actuator (15), and a second valve means (48) for selectively directing fluid from the source (43) to move said first valve means (33) to the second position in response to the temperature level in the heat exchanger (26) exceeding a predetermined level.

2. The fan drive system (10), as set forth in claim 1, wherein said first valve means (33) includes a two position valve (36) movable between a first, spring biased position at which the control signal (34) is connected to the control actuator (15) and a second position at which the control signal (34) is blocked from the control actuator (15) and the control actuator (15) is connected to the tank (14).

3. The fan drive system (10), as set forth in claim 2, including a conduit (42) connecting the second valve means (48) to the source (43) and to one end (44) of the two position valve (36); and wherein the first valve means (33) includes an orifice (46) located in the conduit (42) adjacent the two position valve (36) and being adapted to delay the movement of the two position valve (36) from the first to the second position.

4. The fan drive system (10), as set forth in claim 2, wherein the first valve means (33) further includes means (46) for delaying the movement of the two position valve (36) from the first to the second position for a predetermined time period.

5. The fan drive system (10), as set forth in claim 4, wherein the delaying means (46) includes an orifice (46) located between the second valve means (48) and a pilot chamber (44) of the two position valve (36).

6. The fan drive system (10), as set forth in claim 5, wherein the second valve means (48) includes a second two position valve (50) movable between a first position at which the fluid from the source (43) is connected to the pilot chamber (44) of the first two position valve (36) and a second position at which the fluid from the source (43) is blocked and the pilot chamber (44) is communicated to the tank (14).

7. The fan drive system (10), as set forth in claim 6, wherein the second two position valve (50) is movable from the first position to the second position in response to the temperature level in the heat exchanger (26) exceeding the predetermined level.

8. The fan drive system (10), as set forth in claim 7, including a temperature sensor means (28) for sensing the temperature in the heat exchanger (26) and shifting the second two position valve (50) to the second position in response to the temperature exceeding the predetermined level.

* * * * *